United States Patent [19]

Miyazawa et al.

[11] 4,252,449

[45] Feb. 24, 1981

[54] CONSTRUCTION OF WIRE TYPE DOT PRINTER HEAD

[75] Inventors: Yoshinori Miyazawa; Yoshifumi Gomi, both of Shiojiri, Japan

[73] Assignees: Shinshu Seiki Kabushiki Kaisha; Kabushiki Kaisha Suwa Seikosha, both of Tokyo, Japan

[21] Appl. No.: 38,164

[22] Filed: May 11, 1979

[30] Foreign Application Priority Data

May 2, 1978 [JP] Japan ..... 53/56955
Jul. 21, 1978 [JP] Japan ..... 53/89023

[51] Int. Cl.[3] ..... B41J 3/12
[52] U.S. Cl. ..... 400/124; 101/93.05
[58] Field of Search ..... 400/124; 101/93.05; 428/475.5

[56] References Cited

U.S. PATENT DOCUMENTS

| | | | |
|---|---|---|---|
| 3,828,908 | 8/1974 | Schneider | 101/93.04 X |
| 3,982,622 | 9/1976 | Bellino et al. | 101/93.34 X |
| 4,165,940 | 8/1979 | Cacciola | 101/93.05 X |

OTHER PUBLICATIONS

"Properties and Performance of Nomex Type 411 Paper", DuPont Bulletin N-254, Sep. 1971.

*Primary Examiner*—Paul T. Sewell
*Attorney, Agent, or Firm*—Blum, Kaplan, Friedman, Silberman & Beran

[57] ABSTRACT

In a wire type dot printer head a flat lever pivots on a fulcrum when attracted by an electro-magnetic coil. Pivoting of the lever on the fulcrum drives a print wire or needle, in opposition to a biasing spring, against an ink ribbon and paper for printing on the paper with dots. The biasing spring returns the needle to a stand-by condition after printing. A cantilever spring acts on the lever, being attached near the fulcrum. A spacer sheet, impregnated with a lubricant, is disposed between the lever and the electro-magnetic coil so that lubricant is supplied to the fulcrum of the lever and in the region where the lever engages the print needle or wire. The life of the print head is extended by the availability of lubricant, and the lubricant does not interfere with the printing action. The printer head includes a plurality of similar independently operating needles and drive mechanisms.

9 Claims, 3 Drawing Figures

CONSTRUCTION OF WIRE TYPE DOT PRINTER HEAD

BACKGROUND OF THE INVENTION

This invention relates generally to a printer head and more particularly to a dot printer head used to print on paper by means of a plurality of needles or wires impacting on paper through an ink ribbon. Various structures for mechanical dot printer heads have been developed. This invention relates to a dot printer head which comprises print wires and magnetic devices to drive and selectively extend the print wires upon the occurrence of a printing signal, so that printing may be performed as required on recording paper. More particularly the print head of this invention is of the type wherein magnetic forces produced by magnetic devices are transmitted individually to each print wire through an operating lever thereby indirectly driving the print wires.

The printing action is produced by pivoting the lever about one lever end which acts as a fulcrum. The other end of the lever drives the print wire through a wire guide which aligns all of the plurality of print wires. Therefore, the contacting portions of the operating levers against the print wires, and the fulcrum points are most likely to be worn due to the relative motion between cooperating members under high contact pressure. The durability of these contact points is a major factor in determination of the operating life of the print head.

In order to improve the wearing qualities of these parts in the prior art, the following measures have been adopted. First, the surface hardness at the points of contact of the members has been increased. However, this method has its limitations and is not effective in situations where wear is caused by chemical action, especially in the cases of abrasive corrosion. Moreover, such a hardening technique increases the cost of production. Secondly, lubricants such as grease have been applied. However, in a wire type dot printer head wherein each part repeatedly performs a recipricating motion at high speed, the use of a grease type lubricant has several deficiencies. Namely, because the lubricant disperses very quickly, it is difficult to maintain good lubricating properties over an extended period of time. The splattered lubricant of itself, or a mixture of foreign substances cohering with the lubricant, adheres to the inside of the printer head causing poor operation thereof. Also, at low temperatures, the high viscosity of the lubricant under those conditions often causes a sticking phenomenon.

Accordingly, what is needed is a wire type dot printer head which has a long life as a result of effective lubrication at wear points. Further, it is desirable that the lubricant not cause sticking at low temperatures and the lubricant should not splatter during operation of the printer head.

SUMMARY OF THE INVENTION

Generally speaking, in accordance with the invention, a wire type dot printer head especially suited for printing characters on paper by forming dots, is provided. In the dot printer head of this invention, a flat lever pivots on a fulcrum when attracted by an electromagnetic coil. Pivoting of the lever on the fulcrum drives a print wire or needle, in opposition to a biasing spring, against an ink ribbon and paper for printing on the paper with dots. The biasing spring returns the needle to a stand-by condition after printing. A cantilever spring acts on the lever, being attached near the fulcrum. A spacer sheet, impregnated with a lubricant, is disposed between the lever and the electro-magnetic coil so that lubricant is supplied to the fulcrum of the lever and in the region where the lever engages the print needle or wire. The life of the print head is extended by the availability of lubricant, and the lubricant does not interfere with the printing action. The printer head includes a plurality of similar independently operating needles and drive mechanisms.

Accordingly, it is an object of this invention to provide an improved wire type dot printer head having an extended operating life.

Another object of this invention is to provide an improved wire type dot printing head which is lubricated at critical points of wear.

A further object of this invention is to provide an improved wire type dot printer head which includes means for permanent lubrication.

Still other objects and advantages of the invention will in part be obvious and will in part be apparent from the specification.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
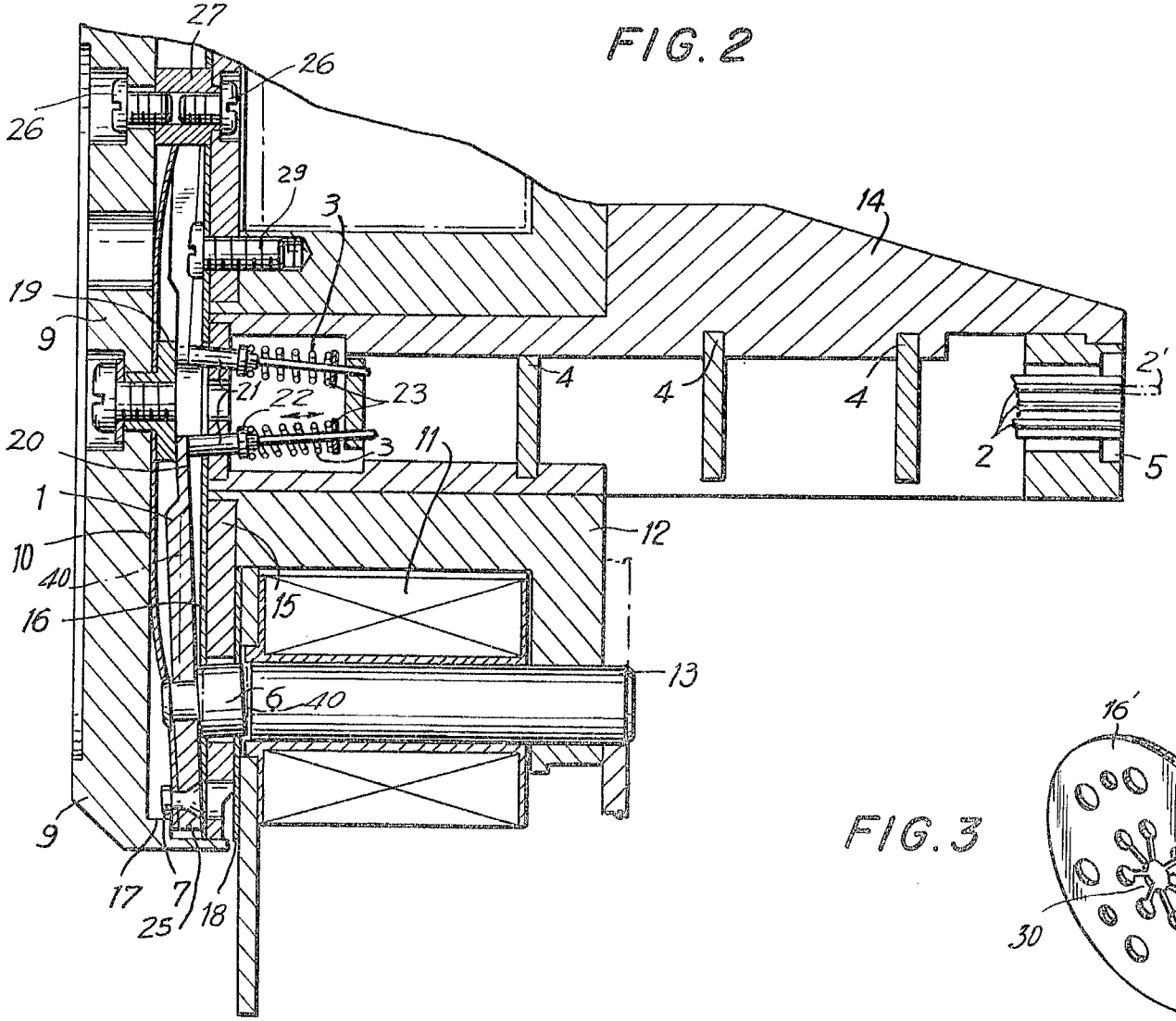
FIG. 2 is a side elevational view in section of the wire type dot printer head of FIG. 1.

With reference to the Figures, a nose piece 14 holds a plurality of print wires or needles 2 and has intermediate guides 4 which prevent deformation of the print wires 2. An end guide 5 aligns and guides the ends of the print wires 2 as they extend from the nosepiece 14 in the known manner when the printer head is actuated. The reference numeral 2' is used to indicate the position of a print wire 2 in its extended position. FIG. 2 shows a stand-by condition of the print wires 2, that is, in their withdrawn state within the nosepiece 14 prior to extension and impact when the dot printer head is actuated. The print wires 2 are biased to the stand-by condition by means of the biasing springs 3 which, as explained more fully hereinafter, oppose the extending motion of the print wires 2 and return the print wires 2 to the stand-by condition after impact printing is completed. A plurality of iron cores 13 are mounted on the yoke 12 in a uniformly spaced circular arrangement and a solenoid coil 11 surrounds each iron core 13. The frame 12 is separated from the yoke plate 15 by a spacer 18, nevertheless, the frame 12 and yoke plate 15 constitute the magnetic circuit.

A plurality of operating levers 1 are constrained between a holding cap 9 and the yoke plate 15. A cantilever spring 10 has as many arms as there are print wires 2, solenoid coils 11, and levers 1. The arms are uniformly spaced to form a spider-like member having a central hub. A pin 7 attaches the arms of the cantilever spring 10 to the outer peripheral end 25 of each lever 1. The central hub of the cantilever spring 10 is restrained between the holding cap 9 and the shoulder of the center stop 19. The center stop 19 is held against the holding cap 9 by the inner ends 20 of the levers 1 which are biased against the center stop 19 by means of the coil springs 3. Thus, the center stop 19 determines the stand-by position of the print wires 2. The inner ends 20 of the levers 1 engage, but are not joined to the shafts 21 which in turn are joined to the print wires 2. A shoulder 22 provided on the shaft 21 constrains the bias spring 3 between said shoulder 22 and the bottom 23 of a cavity in the nosepiece 14.

A small magnetic iron cylinder 6 is fixedly attached to each lever 1. Each magnetic material cylinder 6 extends through an opening in the yoke plate 15 and substantially opposes an iron core 13 having the solenoid coil 11 surrounding it. The outer peripheral ends 25 of the levers 1 are constrained between the fulcrum suppressing member 17, that is, a shoulder within the holding cap 9, and the yoke plate 15.

A spacer sheet 16 is provided between the yoke plate 15 and the pivoting levers 1. The spacer sheet 16 is made of a nonmagnetic material to prevent the operating levers 1 from being attracted thereto. The spacer sheet 16 is permanently impregnated with a lubricant such as lubricating oil and the like. Thus, the lubricant is always supplied to the fulcrum portions 25 of the levers 1 as the fulcrum portions are always in contact with the spacer sheet 16. Thereby friction is substantially eliminated at that point.

The holding cap 9 is joined to the yoke plate 15 by means of bolts 26 which engage spacers 27 from opposite ends. The nosepiece 14 connects to the yoke 12 by means of bolts 28 and bolts 29 secure the yoke plate 15 to the yoke 12 with the solenoid coils 11 and spacer 18 therebetween.

Figure 1:
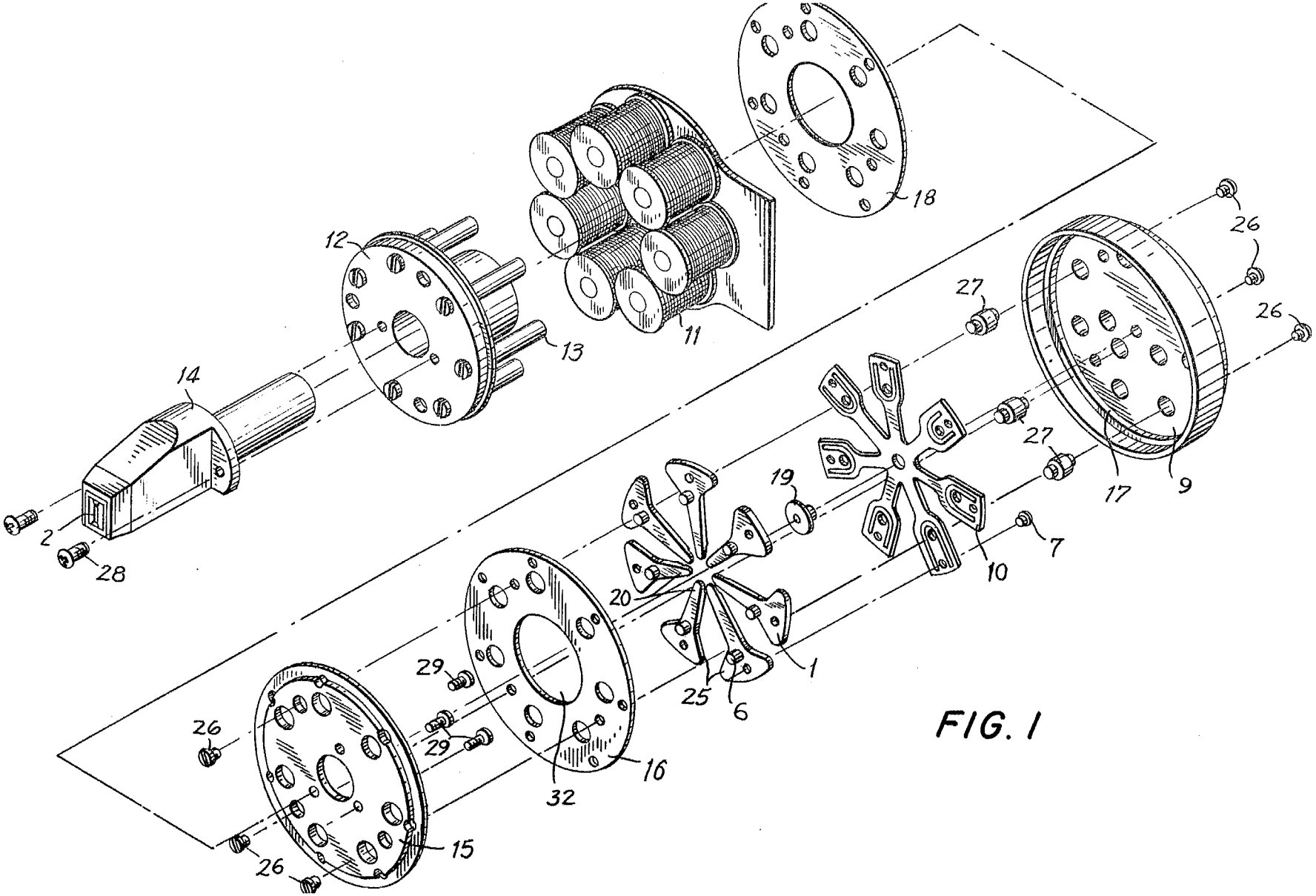
FIG. 1 is an exploded view in perspective of the wire type dot printer head of this invention.
Figure 3:
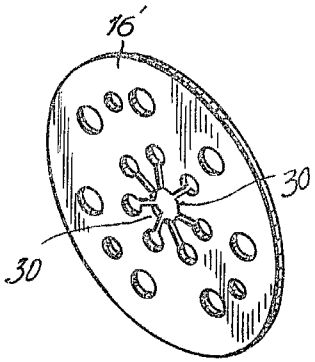
FIG. 3 is an alternative configuration of the lubricating element for the wire type dot printer head of this invention.

The spacer sheet 16 is illustrated in FIG. 1 with a large central opening 32, whereby lubricant is not provided proximate the inner ends 20 of the pivoting levers 1. In an alternative embodiment of this invention, the spacer sheet 16' is provided (FIG. 3) with tongue-shaped projections 30 which extend to the region where the levers 1 contact the shafts 21 of the print wires 2. Thereby lubrication is readily provided to the ends of the print wires 2 and to the driven inner ends 20 of the operating levers 1 by capillary action of the lubricant.

Accordingly, lubricant is continuously provided at the points of moving contact in the printer head and the wear resistance at those points is extremely improved. The operating life life of the print head is extended.

Having the lubricant contained in the spacer sheet 16 provides many advantages. Lubrication is performed effectively and a lubricant with low viscosity, which is not subject to the above described sticking phenomenon, can be used. The lubricant can be selected over a wider range of viscosities and there is no splattering during print operations. Additionally, the manhours required for oiling the print head can be saved by impregnating the spacer sheet 16 with lubricant before assembling the print head. The spacer sheet 16 is made of non-magnetic material having high mechanical strength, high wear resistance, and good impregnating properties. An aramid paper, for example, NOMEX paper made by the DuPont Corporation, is a material which has been impregnated and used with favorable results.

As stated above, FIG. 2 illustrates in section the print head of this invention in the stand-by position with the solenoid coils deenergizied. When a solenoid coil is electrically energized, the magnetic field induced in the magnetic circuit comprising the iron core 13, yoke 12 and yoke plate 15, draws the magnetic cylinder 6 toward the iron core 13 to the position indicated by the broken lines 40. In so moving, the lever 1 associated with the energized coil 11 pivots about the outer peripheral end 25 causing the inner lever end 20 to drive the contacting shaft 21 and associated print wire 2 in the direction of the end guide 5. When the coil 11 causes the lever 1 to pivot, the lubricant impregnated spacer sheet 16 is somewhat compressed thereby lubricating the adjacent surfaces near the contact point 20 as the print wire 2 moves in opposition to the force generated by the spring 3. The fulcrum 25 is always lubricated by contact with the spacer sheet 16. Further, as the lever 1 pivots, the cantilever spring 10 is flexed. When the coil 11 is deenergized, the action of the springs 3, 10 rapidly returns the lever 1 and print wire 2 to the stand-by condition indicated in FIG. 2.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A dot printer head comprising:

a plurality of fixed iron cores;

a first yoke on which said fixed iron cores are mounted;

a second yoke provided with said first yoke;

fulcrum means;

a plurality of pivotable levers, each lever having a movable iron element affixed thereto and disposed to face said fixed iron core, each of said levers extending radially from a common center, each said lever being mounted for pivoting about one end, said one end bearing on said fulcrum means;

a lever suppressing member for pressing against the pivot points of said movable levers, a portion of said lever supressing member being elastically supported;

a plurality of print wires, each of said wires contacting the other end of one said lever, each said print wire being driven when said contacted lever pivots;

magnetic means for pivoting said levers from a stand-by position to an actuated position;

unitary spacer sheet means interposed between said second yoke and said pivotable levers, said unitary spacer sheet means having a plurality of radial tongues extending toward said common center, each of said radial tongues terminating proximate the contact points of said levers with said print wires, said spacer sheet means being impregnated with lubricant and positioned intermediate the pivoting points of said levers and said fulcrum means and extending both intermediate said pivoting points and fulcrum means and proximate said points of contact of said levers with said print wires;

whereby lubrication is provided at the pivoting points of said levers, wear is reduced, and the life of said printer head is extended.

2. A dot printer head as claimed in claim 1 and further comprising return means for moving said levers to said stand-by position from said actuated position.

3. A dot printer head as claimed in claim 2 and further comprising bias means for maintaining contact between said print wires and said levers when at stand-by position.

4. A dot printer head as claimed in claim 3 and further comprising guide means for directing the longitudinal paths of said print wires when driven.

5. A dot printer head as claimed in claim 3 wherein said return means and contact maintaining means at each wire includes a spring, said spring opposing said pivoting motion of said lever.

6. A dot printer head as claimed in claim 1, wherein said lever suppressing member includes means for limiting the return travel of said lever to said stand-by position when said magnetic means has been deenergized after printing.

7. A dot printer head as claimed in claim 6, wherein said suppressing member includes a flexible cantilever spring, said cantilever spring acting on said pivoted end of each said lever.

8. A dot printer head as claimed in claim 1 wherein said spacer sheet means is of aramid paper impregnated with lubricant.

9. A dot printer head as claimed in claim 1 wherein said lubricant is oil.

* * * * *